US010035694B1

(12) United States Patent
Broen et al.

(10) Patent No.: US 10,035,694 B1
(45) Date of Patent: Jul. 31, 2018

(54) ADVERTISING ACCESSORIES FOR BAR GUNS

(71) Applicant: PepsiCo, Inc., Purchase, NY (US)

(72) Inventors: Martin Eduardo Broen, New York, NY (US); Stephen Lim, Chappaqua, NY (US); Klaus Rosburg, Brooklyn, NY (US)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 15/593,464

(22) Filed: May 12, 2017

(51) Int. Cl.

| | |
|---|---|
| ***B67D 1/08*** | (2006.01) |
| ***G09F 7/18*** | (2006.01) |
| ***G09F 23/06*** | (2006.01) |
| *B67D 1/00* | (2006.01) |

(52) U.S. Cl.
CPC ..... *B67D 1/0877* (2013.01); *G09F 7/18* (2013.01); *G09F 23/06* (2013.01); *B67D 1/0081* (2013.01); *G09F 2007/1843* (2013.01); *G09F 2007/1856* (2013.01)

(58) Field of Classification Search
CPC .. B67D 1/0877; B67D 1/0081; B67D 1/0084; G09F 7/18
See application file for complete search history.

(56) References Cited

U.S. PATENT DOCUMENTS 3,241,720 A * 3/1966 Barney ..... B67D 1/0084 200/314
6,061,942 A * 5/2000 Alvern ..... B67D 7/426 141/98
7,255,142 B2 * 8/2007 Carder, Sr. ..... B67D 7/3236 141/392
9,284,176 B2 3/2016 Tuyls et al.
2003/0213153 A1 * 11/2003 Kim ..... G09F 7/18 40/607.14
2009/0145927 A1 * 6/2009 Salmela ..... B67D 1/0084 222/144.5
2010/0000133 A1 * 1/2010 Kent ..... G09F 3/20 40/124.02
2010/0320231 A1 * 12/2010 Martindale ..... B67D 1/0084 222/113
2012/0144708 A1 * 6/2012 Schwartz ..... G09F 7/10 40/611.01
2013/0103488 A1 * 4/2013 Orloff ..... G09F 23/0083 705/14.39
2014/0001203 A1 * 1/2014 Goldstein ..... G09F 23/06 222/23
2015/0052790 A1 * 2/2015 Logue ..... B67D 1/0877 40/332
2016/0060091 A1 * 3/2016 Hecht ..... B67D 1/0084 362/109

OTHER PUBLICATIONS

Vimeo from Dot Design Group at https://vimeo.com/204263174, accessed on May 11, 2017.

* cited by examiner

*Primary Examiner* — Gary C Hoge
(74) *Attorney, Agent, or Firm* — Sterne, Kessler, Goldstein & Fox P.L.L.C.

(57) ABSTRACT

Advertising accessories for bar guns are disclosed. An advertising accessory for a bar gun may include a frame and a front face extending from one side of the frame. A user interface void may be formed in the frame. The frame may be configured to mate with a user interface of a bar gun. A clip extending from the front face may engage a nozzle surface of the bar gun to couple the advertising accessory to the bar gun.

20 Claims, 7 Drawing Sheets

ADVERTISING ACCESSORIES FOR BAR GUNS

FIELD

The described embodiments relate generally to advertising accessories. Specifically, the described embodiments relate to advertising accessories for bar guns.

SUMMARY

According to some embodiments disclosed, an advertising accessory includes a frame and a front face extending from one side of the frame. The front face may include a branding area that extends across some or all of the front face. The branding area may show advertisements, such as, for example, logos or trademarks. A user interface void may be formed in the frame and may be configured to receive a user interface plate of a bar gun. The advertising accessory may also include a locking clip that extends from the front face and is parallel to the frame. The clip may be configured to engage a nozzle surface of the bar gun. The clip and frame couple the advertising accessory to the bar gun. In some embodiments, the frame extends around the user interface plate of the bar gun. In some embodiments, the clip and frame form a snap fit connection between the advertising accessory and the bar gun.

In some embodiments, the advertising accessory includes a badge mating surface. The badge mating surface may be formed on the front face of the advertising accessory and may be configured to engage branding badges. The branding badges may be interchangeable and each branding badge may contain a different advertisement such as, for example, beverage logos, corporate logos, sport team logos, other logos, trademarks, or service marks. The branding badges may be removably coupled to the badge mating surface such that the badges can be changed to customize the advertising experience. The branding badges may mate with the badge mating surface using a friction connection, a snap lock connection, or other connection type, such as, for example, a screw, adhesive, or interference fit.

An advertising accessory according to some embodiments has a frame thickness at the user interface void that is the same as a thickness of the user interface plate of the bar gun that is exposed above a top surface of the bar gun. When the frame thickness at the user interface void and the thickness of the user interface plate are the same, the user interface plate and the advertising accessory may present a smooth, continuous appearance.

In use, an advertising accessory for a bar gun may have a front face that faces away from the user of the bar gun. In this way, a customer at a bar, restaurant, or other establishment is presented with the advertisement shown on the front face of the advertising accessory as the beverage is dispensed. The presentation of the brand may enhance brand recognition and contribute to greater brand recognition. In some embodiments, the front face displays a beverage logo or trademark. The displayed logo or trademark may correspond to a beverage that may be dispensed. When the bar gun with an advertising accessory is used to dispense a beverage, the branding area faces away from the user of the bar gun.

The advertising accessory may be coupled to the bar gun using only a snap fit connection created between the frame of the advertising accessory and the locking clip. That is, the advertising accessory may be coupled to the bar gun without the use of adhesives or fasteners. A rear face of the advertising accessory may be bounded on one side by the locking clip and on two sides by lateral support protrusions. The locking clip and lateral support protrusions may extend on to different surfaces of the bar gun. In some embodiments, the advertising accessory includes a removal tab formed on the frame. The removal tab may be formed as a depression in the frame opposite the front face of the advertising accessory. The removal tab may aid a user in removing the advertising accessory from the bar gun. The removal tab may extend across all or a portion of the length or width of one side of the advertising accessory.

In some embodiments, the advertising accessory for a bar gun does not include a void. In some of these embodiments, the advertising accessory for the bar gun and the user interface plate of the bar gun may be a unitary structure and may be secured to the bar gun with fasteners, such as, for example, screws.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

The present disclosure is directed to an advertising accessory for a bar gun. Branding facilitates consumer recognition of goods and services and my also create new revenue streams for vendors. The advertising accessory mates with the user interface frame of the bar gun and extends over a front edge of the bar gun. In some embodiments, the advertising accessory and user interface plate may be a single structure and may be mounted to the bar gun.

A bar gun is a beverage dispensing device that includes a dispensing nozzle and beverage dispensing buttons. The dispensing buttons are located on a user interface plate. The user interface plate organizes the dispensing buttons. When a user of a bar gun selects a dispensing button on the user interface plate, the corresponding beverage is dispensed from one or more beverage reservoirs from the dispensing nozzle. Bar guns are a staple of the beverage industry are commonly used in restaurants, bars, concessions, and other high-volume beverage-dispensing operations.

Bar guns allow bartenders and other operators to switch quickly between dispensed beverages improving the bartender's efficiency and customer satisfaction. Bar guns present a limited surface for advertisement bar guns have a relatively small exposed surface when in use. The limited surface are exists not only because the bar gun itself is a small object, but also because much of the relatively small area is obscured by the user's hand when the bar gun is operated.

The present disclosure is directed to embodiments of an advertising accessory for a bar gun. The disclosed embodiment expand and/enhance an advertising area of the bar gun. The advertising accessory has a front face that may display advertisements such as logos, slogans, or other information. The front face may have a badge mating portion configured to replaceably mate with branding badges. Branding badges may contain corporate logos, beverage logos, or other brand identifiers. In this way, the advertising accessory may display a wide variety of branding badges.

These and other embodiments are discussed below with reference to the figures. However, those skilled in the art will readily appreciate that the detailed description given herein with respect to these figures is for explanatory purposes only and should not be construed as limiting.

Figure 1:
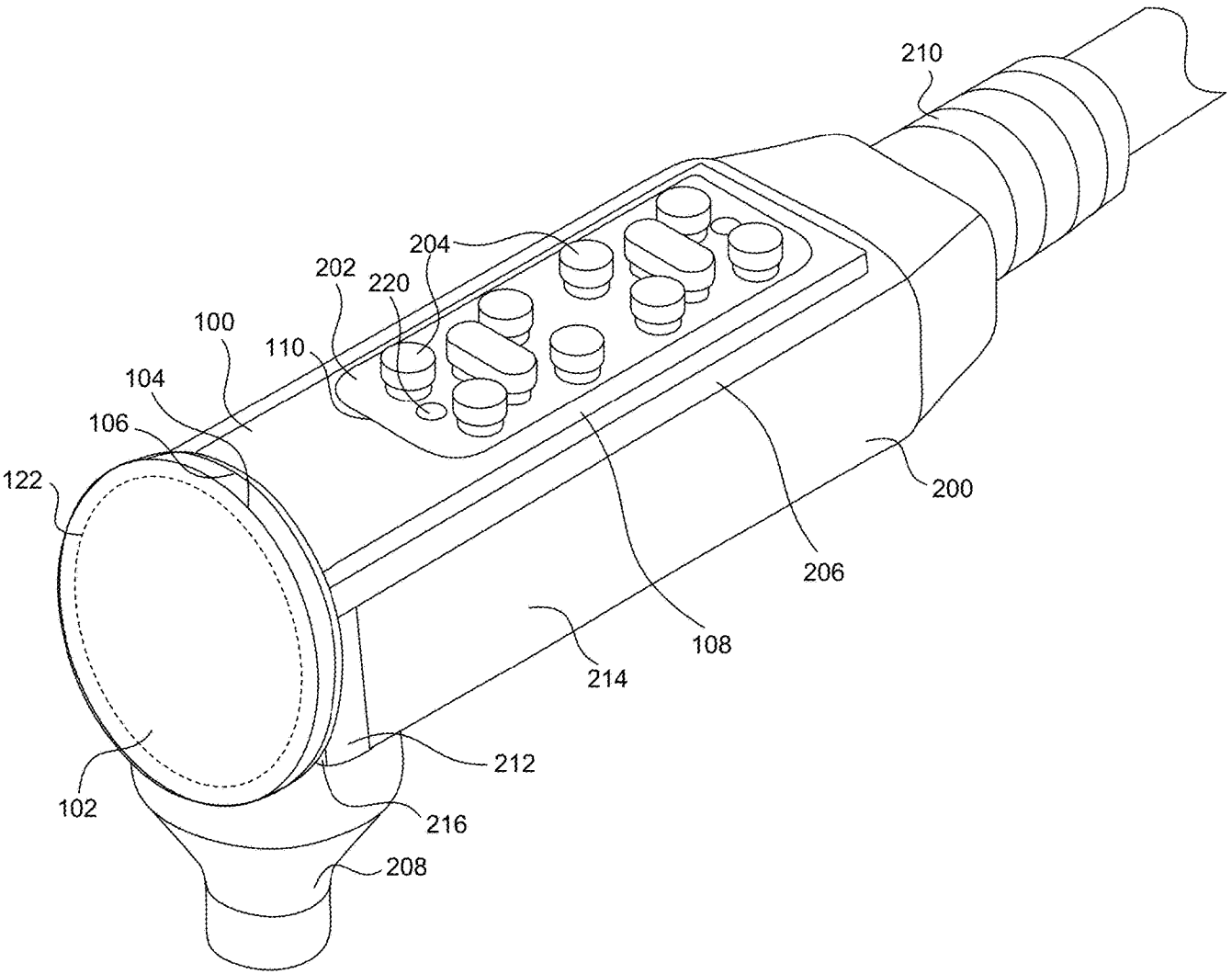
FIG. 1 shows a bar gun with an advertising accessory.

In some embodiments, for example as shown in FIG. 1, an advertising accessory 100 is coupled to a bar gun 200. Advertising accessory 100 includes a frame 108 and a front face 102 located at a front side of the frame. Frame 108 rests on a top surface 206 of bar gun 200. A user interface void 110 is formed in frame 108 and surrounds a user interface plate 202 of bar gun 200. A front face 216 of bar gun 200 is at least partially obscured by front face 102 of advertising accessory 100. Front face 102 includes branding area 122. Branding area 122 may include advertisements, such as, for example, logos or other branding and may contain two dimensional brand representations, such as, for example, stickers or surface printing, or may contain three dimensional brand representations, such as, for example, raised, textured, or contoured logos. In some embodiments a branding badge 104 may be mated to a badge mating surface 106 to form front face 102 and branding area 122 as a part of branding badge 104, as shown in FIG. 1.

Advertising accessory 100 may be made of plastic, resins, metal, or other materials. For example, advertising accessory 100, or components thereof, may be made of polytetrafluoroethylene. Advertising accessory 100, or components thereof, may be formed using an injection molding process.

Figure 2:
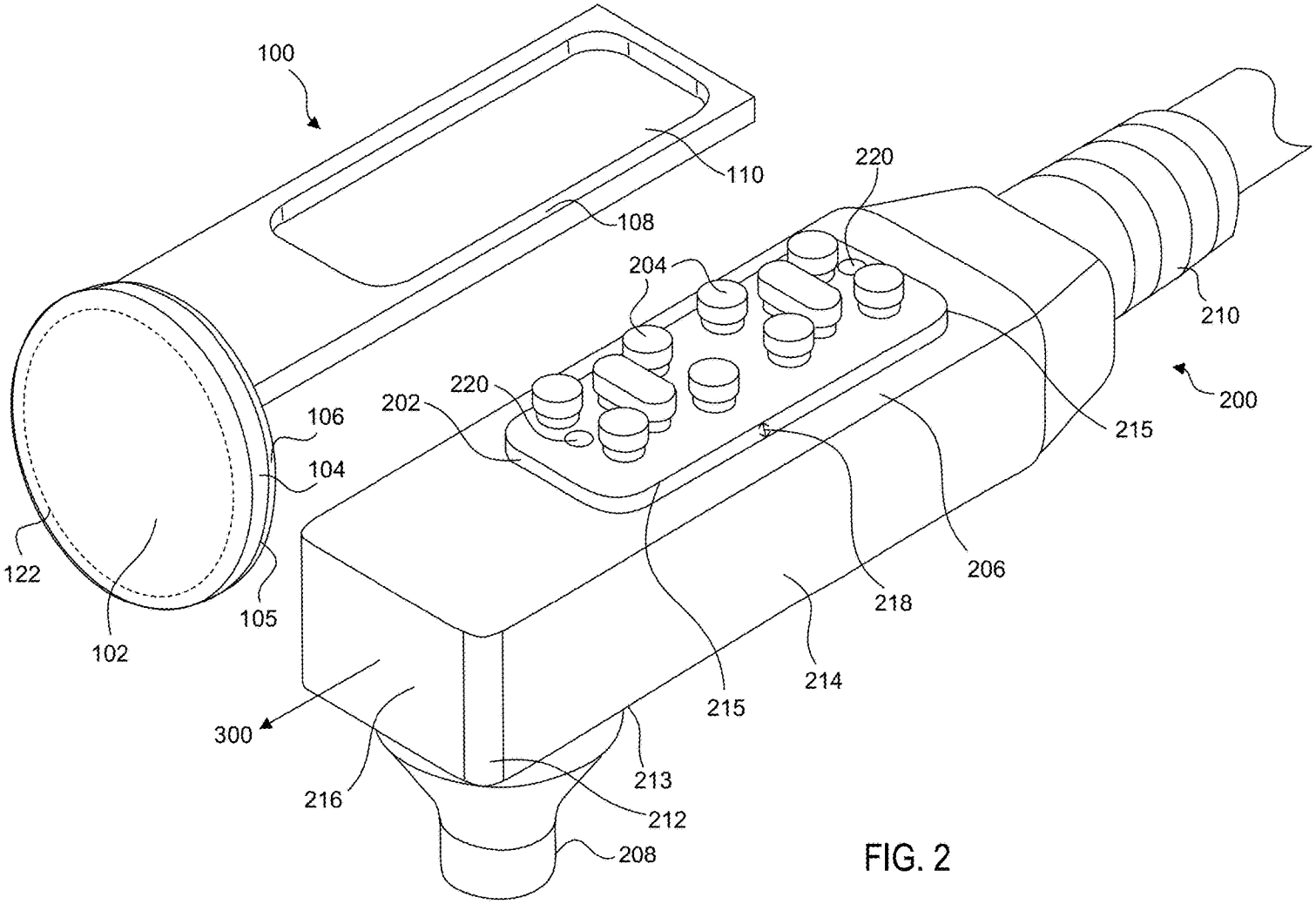
FIG. 2 shows an exploded view of the bar gun with advertising accessory of FIG. 1.

FIG. 2 shows an exploded view of advertising accessory 100 and bar gun 200 according to some embodiments. Bar gun 200 includes a central body 214. Central body 214 contains mechanical systems necessary for the operation of bar gun 200. Central body 214 is connected to a beverage supply line 210. Beverage supply line 210 supplies beverages and beverage ingredients to bar gun 200 in response to a user's selection at user interface plate 202. Nozzle 208 is located opposite of beverage supply line 210. Nozzle 208 extends from a bottom surface 213 of bar gun 200. User interface plate 202 is disposed at a top surface 206 of bar gun 200. User interface plate 202 has a user interface plate thickness 218. User interface plate thickness 218 may be defined as the portion of user interface plate 202 that extends above top surface 206 of bar gun 200.

Bar gun 200 includes user interface plate 202. User interface plate 202 may be coupled to bar gun 200 using, for example, fasteners or adhesives. Fasteners 220 may include screws or other mechanical fasteners. In some embodiments, an adhesive holds user interface plate 202 to bar gun 200. User interface plate 202 includes dispensing buttons 204. Dispensing buttons 204 may be labeled with various brands of beverages or beverages to be dispensed. For example, one dispensing button 204 may be labeled Pepsi-Cola®, another dispensing button 204 may be labeled water, and another dispensing button 204 may be labeled soda. Depressing each respective button causes bar gun 200 to dispense Pepsi-Cola®, water, and soda water, respectively. Each dispensing button 204 is associated with different input lines which a user may adjust at the beverage source, such as, for example, under the bar counter. In some embodiments, dispensing buttons 204 may be rearranged on user interface plate 202. A corresponding change may need to be made to the input lines so the dispensed product matches the label of dispensing button 204. This may be particularly useful because it allows the bar gun 200 operator to customize user interface plate 202 to match dispensed content.

Bar gun 200 has a front face 216. As shown in FIG. 2, front face 216 is perpendicular (for example, disposed between 70° and 110° to one another) to top surface 206 of bar gun 200 and is parallel (for example, disposed between 0° and 20° to one another) to an output direction of nozzle 208. When bar gun 200 is in use, front surface 216 faces the patron, which is across from the user of bar gun 200 (e.g., across a bar).

According to some embodiments, advertising accessory 100 attaches to bar gun 200 through a snap fit connection. Frame 108 extends around user interface plate 202 such that user interface plate 202 extends into user interface void 110 of frame 108. Frame 108 may have a frame thickness 124. Frame thickness 124 may be the same as user interface plate thickness 218 to minimize a seam formed between user interface plate 202 and frame 108. Minimizing the seam may improve the user experience and give bar gun 200 with advertising accessory 100 a cleaner, more integrated appearance.

Figure 4:
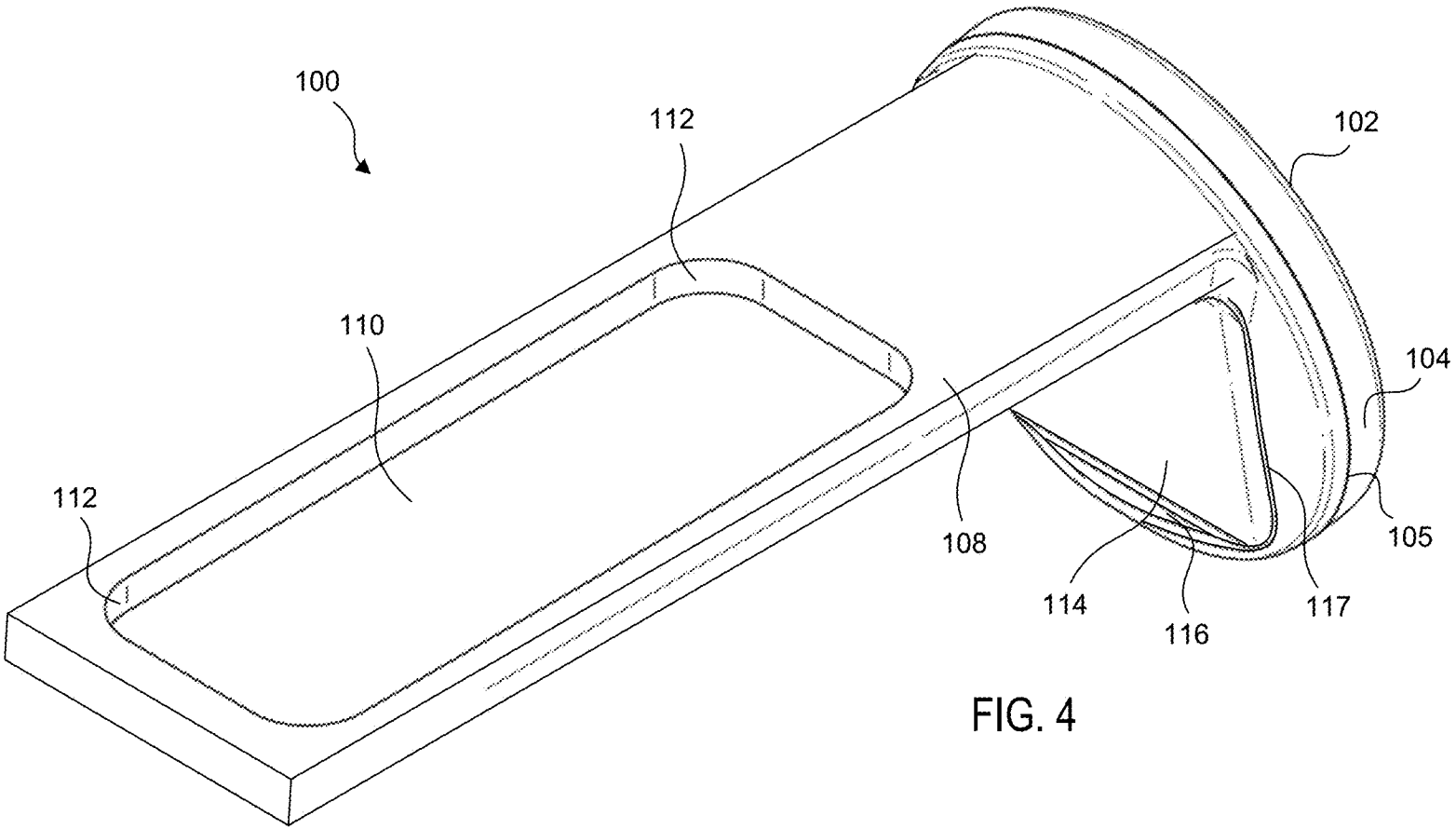
FIG. 4 shows a top rear perspective view of the advertising accessory of FIG. 1.

Front face 102 of advertising accessory 100 extends over front face 216 of bar gun 200. A locking clip 116, for example as shown in FIG. 4, extends over bottom surface 213 of bar gun 200. Locking clip 116 and frame 108 create a snap fit connection hold advertising accessory 100 to bar gun 200.

Advertising accessory 100 may be added to existing bar guns in the market by taking advantage of structural features of bar gun 200. As discussed with respect to FIG. 2 above, existing bar guns 200 include bottom surface 213 and user interface plate 202. Advertising accessory 100 connects to bar gun 200 and presents a clean, smooth, integrated appearance. Advertising accessory 100 is an economical addition to existing bar guns in the market.

Figure 3:
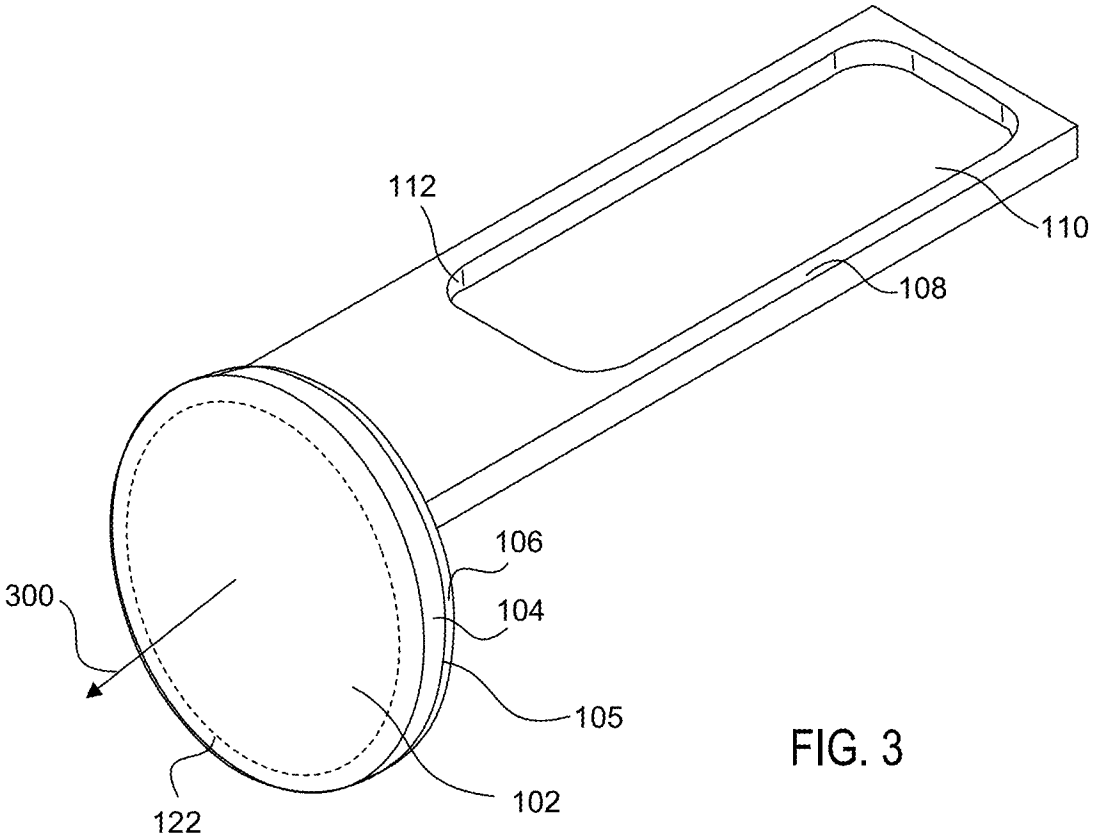
FIG. 3 shows a top front perspective view of the advertising accessory of FIG. 1.

FIG. 3 shows advertising accessory 100. Front face 102 presents a branding area 122 in the direction of patron 300. Direction of patron 300 points to where patrons of establishments using bar gun 200 may be located. For example, when bar gun 200 is used at a bar where patrons interact with bartenders opposite a counter, the bartender, as the user of bar gun 200, is located in the opposite direction of direction of patron 300. Seam 105 is shown between badge mating surface 106 and branding badge 104.

Seam 105 may be present in embodiments where advertising accessory 100 uses interchangeable branding badges 104 as described in further detail below. User interface void 110 is formed in frame 108. User interface void 110 has corners 112. Corners 112 match the corner contours 215 of bar gun 200's user interface plate 202. Corners 112 have a smooth geometry and smoothly connect the four straight edges of user interface void 110. User interface void 110 is sized the same as or slightly larger than user interface plate 202 to provide a tight mating between user interface plate 202 and advertising accessory 100.

FIG. 4 shows a rear perspective view of advertising accessory 100. A rear face 114 is bounded by locking clip 116 and lateral support protrusions 117. Locking clip 116 extends beyond rear face 114 and is configured to engaged bottom surface 213 of bar gun 200. Lateral support protrusions 117 extend beyond front face 216 of bar gun 200, around rounded corners 212, and may extend to side 214 of bar gun 200. Lateral support protrusions 117 keep advertising accessory 100 symmetrically located on front face 216 of bar gun 200. As discussed above, locking clip 116 and frame 108 create a snap fit that holds advertising accessory 100 securely to bar gun 200. The use of a snap fit connection allows for the quick introduction and removal of advertising accessory 100 to bar gun 200 without the need of any additional adhesives or fasteners. In this way, bar gun 200's operator can change the branding bar gun 200 by changing advertising accessory 100.

Figure 5:
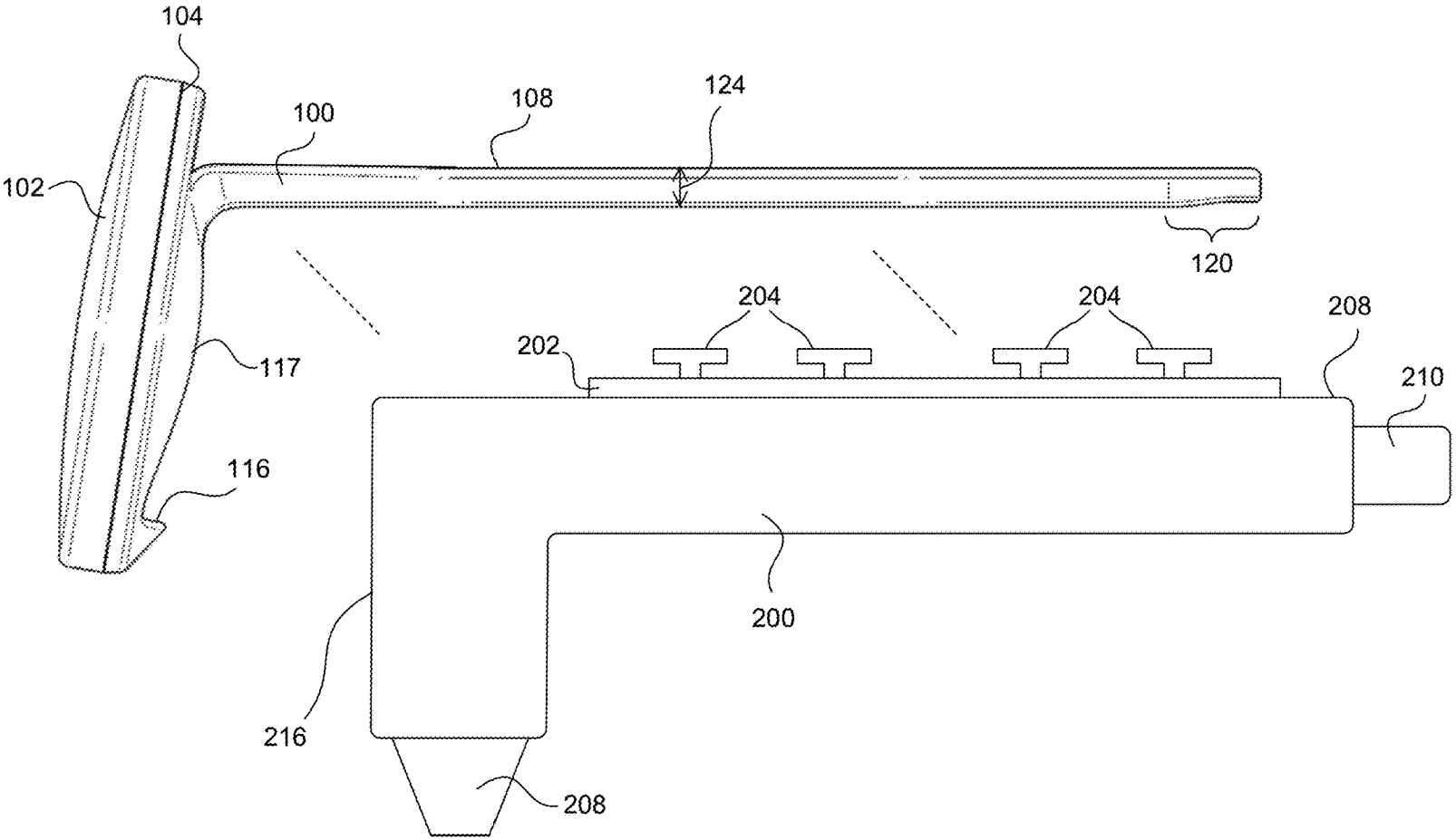
FIG. 5 shows a left side view of the advertising accessory of FIG. 1 and a bar gun.

FIG. 5 shows a left side view of an advertising accessory 100 according to an embodiment. Advertising accessory 100 has frame thickness 124. As discussed above, frame thickness 124 may be the same as user interface plate thickness 218. A removal tab 120 is located on frame 108 opposite of front face 102. Removal tab 120 aids a user of advertising accessory 100 in removing advertising accessory 100 from bar gun 200. Advertising accessory 100 connected to bar gun 200 may be removed by inserting an object, such as, for example, a finger or spoon tip, at removal tab 120 between frame 108 and top surface 206 of bar gun 200. Advertising accessory 100 may be removed by pulling on removal tab 120 and lifting frame 108 away from top surface 206 of bar gun 200. Once frame 108 is a sufficient distance from top surface 206 of bar gun 200, advertising accessory 100 separates from bar gun 200. In this way, advertising accessory 100 can be said to "snap off" of bar gun 200. In some embodiments, the removal tab is formed as a depression in frame 108 so create a space between frame 108 and top surface 206 of bar gun 200.

Figure 6:
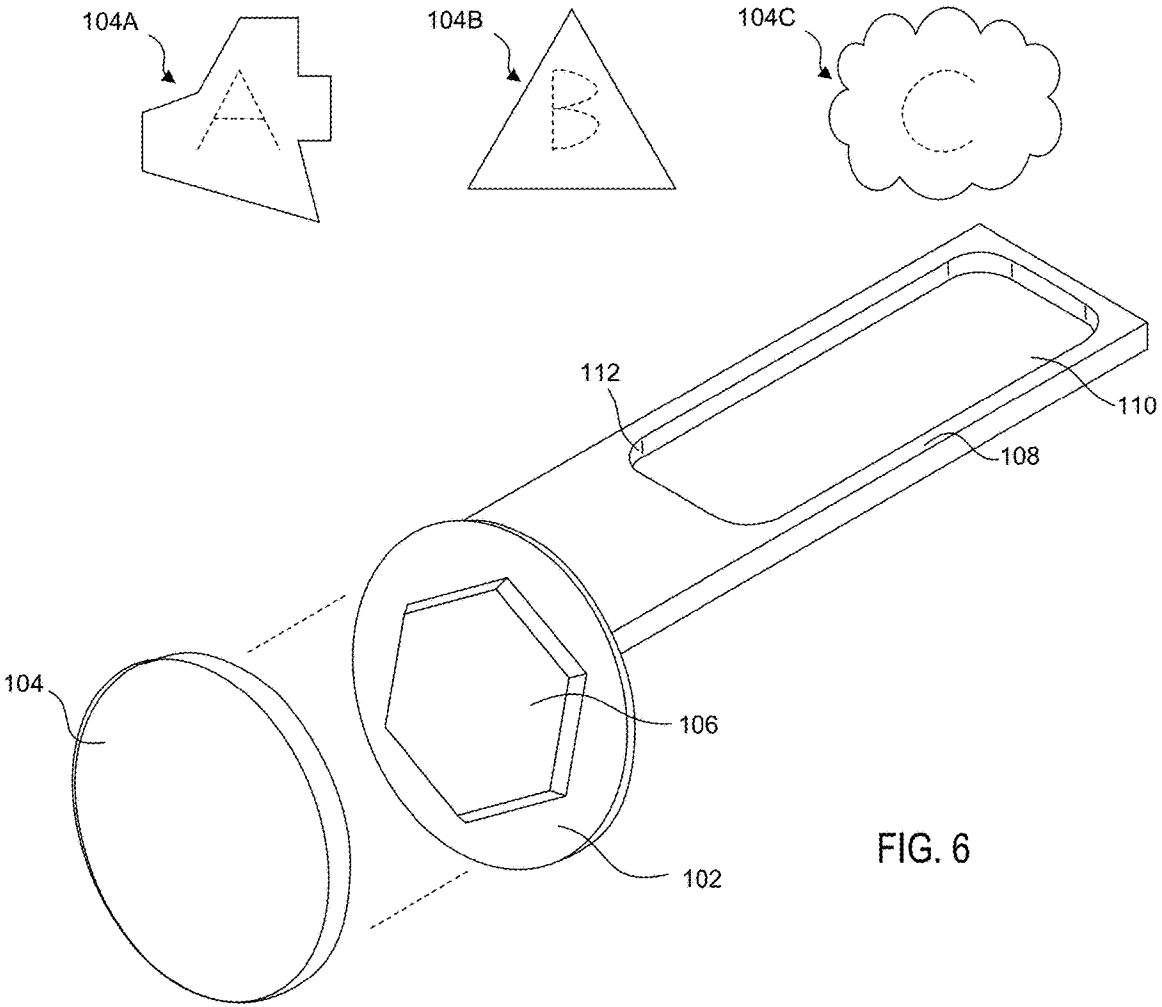
FIG. 6 shows the advertising accessory of FIG. 1 and advertising badges.

FIG. 6 shows advertising accessory 100 according to an embodiment. As shown, advertising accessory 100 includes a badge mating surface 106. Badge mating surface 106 is configured to mate with branding badge 104. Branding badge 104 may be removable and interchangeable. Interchanging branding badges 104 make advertising accessory 100 customizable. Representative structures are shown in FIG. 6 as branding badges 104A, 104B, and 104C.

According to some embodiments, the advertisement or branding of advertising accessory 100 may be changed by exchanging branding badges 104 on badge mating surface 106. Each branding badge 104 may show different logos or trademarks and may be changed by a user depending on available products, seasonal offerings, local events, or holidays. For example, branding badge 104 may show a logo of a beverage available from bar gun 200. Alternatively, for example, branding badge 104 may show a sport team's logo or other trademark. A user wishing to change the branding of advertising accessory 100 may remove branding badge 104 from badge mating surface 106. Branding badge 104 and badge mating surface 106 may have a snap fit connection allowing for easy exchange of branding badges 104. In some embodiments, badge mating surface 106 may include a screw or other connection interface such that branding badge 104 may be screwed on or otherwise fixed to badge mating surface 106.

Figure 7:
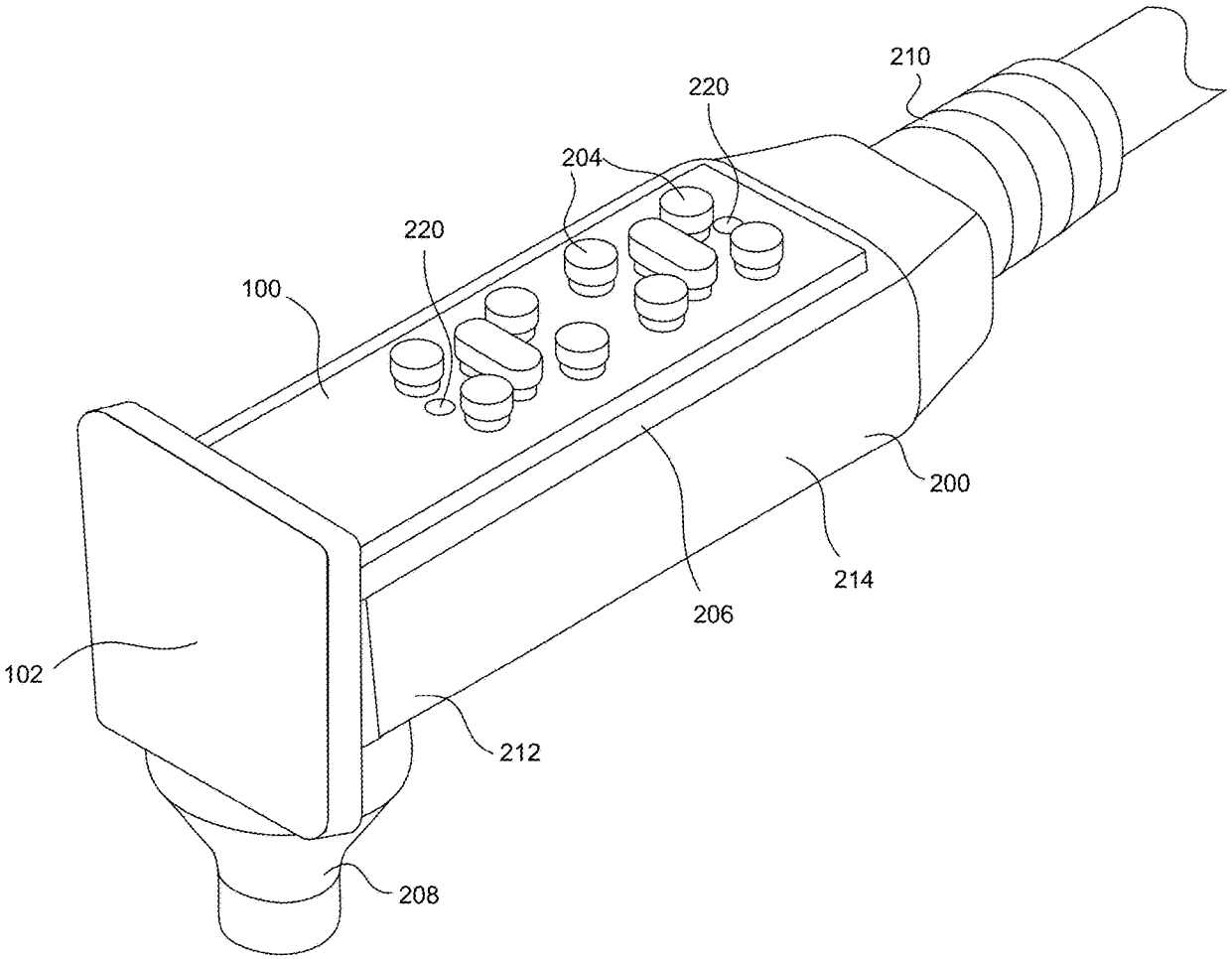
FIG. 7 shows a bar gun with an advertising accessory.

FIG. 7 shows advertising accessory 100 according to an embodiment. As shown in FIG. 7, user interface plate 202 and advertising accessory 100 are a unitary structure. According to these embodiments, advertising accessory 100 is not a removable structure but is attached to bar gun 200 in a more permanent manner, such as, for example, with adhesives. According to these embodiments, advertising accessory 100 is attached to bar gun 200 and only branding badges 104 are changed to change the branding of bar gun 200. According to these embodiments, a unitary advertising accessory 100 and user interface plate 202 may be shipped with new bar guns 200 or may replace user interface plate 202 of an existing bar gun 200. A unitary frame and user interface place 202 structure as shown in FIG. 7 may also be used with branding badges 104.

According to some embodiments, advertising accessory 100 may not include removable branding badges 104 but may have a unitary front face 102. In these embodiments, front face 102 does not include any removable or interchangeable components such as branding badge 104. Accordingly, advertising accessory 100 may be a unitary structure. According to these embodiments, advertising accessory 100 may be exchanged with another advertising accessory 100 on bar gun 200. In this way, the branding of bar gun 200 may be changed. A vendor of beverage products may supply advertising accessory 100 with shipments of beverage products. When bar gun 200's user receives the shipment, the user may attach advertising accessory 100 to bar gun 200. The beverage vendor may supply bar gun 200 user with either a single branded advertising accessory or may supply the user with advertising accessory 100 and branding badges 104 displaying different products.

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein.

The Detailed Description section is intended to be used to interpret the claims. The Summary and Abstract sections may set forth one or more but not all exemplary embodiments of the present invention as contemplated by the inventor(s), and thus, are not intended to limit the present invention and the claims.

The phraseology or terminology used herein is for the purpose of description and not limitation, such that the terminology or phraseology of the present specification is to be interpreted by the skilled artisan.

The breadth and scope of the present invention(s) should not be limited by any of the above-described exemplary embodiments, but should be defined only in accordance with the claims and their equivalents.

What is claimed is:

1. An advertising accessory for a bar gun, the advertising accessory comprising:

a frame;

a branding portion extending from the frame, the front face branding portion perpendicular to the frame;

a branding area on a front face of the branding portion, a user interface void formed in the frame and configured to receive a user interface plate of a bar gun; and a locking clip extending from a rear face of the branding portion and parallel to the frame, the locking clip configured to engage a bottom surface of the bar gun, wherein the front face displays an advertisement, wherein the front face is configured to be opposite of a beverage supply line of a bar gun when the advertising accessory for a bar gun is coupled to a bar gun, and wherein the frame is configured to extend around the entire perimeter of the user interface plate of the bar gun.

2. The advertising accessory of claim 1, wherein the rear face is bounded on one side by the locking clip and on two sides by lateral support clips.

3. An advertising accessory for a bar gun, the advertising accessory comprising:

a frame;

a branding portion coupled to a front end of the frame and extending perpendicularly from the frame;

a user interface void formed in the frame and configured to receive a user interface plate of a bar gun; and a locking clip extending from a front face of the branding portion and parallel to the frame, the locking clip configured to engage a bottom surface of a bar gun, wherein a front face of the branding portion displays an advertisement, and wherein the frame is configured to extend around the entire perimeter of the user interface plate of the bar gun.

4. The advertising accessory of claim 3, wherein the front face includes an advertising badge mating surface configured to removably receive an advertising badge.

5. The advertising accessory of claim 4, further comprising an advertising badge removably coupled to the badge mating surface.

6. The advertising accessory of claim 3, wherein a thickness of the frame at the user interface void is the same as a thickness of the user interface plate of the bar gun.

7. The advertising accessory of claim 3, wherein the advertisement is a beverage logo.

8. The advertising accessory of claim 3, wherein the advertisement is a trademark.

9. The advertising accessory of claim 3, wherein the advertising accessory is coupled to the bar gun without adhesives.

10. The advertising accessory of claim 3, wherein the rear face is bounded on one side by the locking clip and on two sides by lateral support clips.

11. The advertising accessory of claim 3, further comprising a removal tab formed on the frame, the removal tab formed as a depression in the frame opposite the front face.

12. The advertising accessory of claim 11, wherein the depression formed in the frame does not extend across a width of the frame.

13. An advertising accessory for a bar gun, the advertising accessory comprising:

a frame;

a branding portion extending from a front side of the frame, the branding portion perpendicular to the frame, the front face of the branding portion having a branding area; and a locking clip extending from a rear face of the branding portion and parallel to the frame, wherein the branding area is disposed on the front face opposite the frame and displays an advertisement.

14. The advertising accessory of claim 13, further comprising a user interface void formed in the frame.

15. The advertising accessory of claim 13, wherein the frame is configured to mate with a top surface of the bar gun.

16. The advertising accessory of claim 13, wherein the frame is configured to receive dispensing buttons.

17. The advertising accessory of claim 13, wherein the advertising accessory is configured to attach to the bar gun without using fasteners screws.

18. The advertising accessory of claim 13, further comprising a removal tab configured to aid a user in removing the advertising accessory from the bar gun.

19. The advertising accessory of claim 13, wherein the advertisement is a beverage logo.

20. The advertising accessory of claim 13, wherein the branding area is configured to removably receive an advertising badge.

* * * * *